United States Patent [19]

Braun et al.

[11] Patent Number: 4,893,462

[45] Date of Patent: Jan. 16, 1990

[54] OPEN-END SPINNING MACHINE AND PROCESS FOR THE START-UP OF SUCH A DEVICE

[75] Inventors: Erwin Braun; Eberhard Grimm, both of Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 227,816

[22] Filed: Aug. 3, 1988

[30] Foreign Application Priority Data

Aug. 10, 1987 [DE] Fed. Rep. of Germany ..... 3726531

[51] Int. Cl.[4] ..... D01H 7/885; D01H 15/02

[52] U.S. Cl. ..... 57/302; 57/263; 57/304

[58] Field of Search ..... 57/302, 301, 304, 305, 57/261-263, 411, 415

[56] References Cited

U.S. PATENT DOCUMENTS

| | | | |
|---|---|---|---|
| 3,597,911 | 8/1971 | Schiltknecht | 57/302 |
| 3,760,577 | 9/1973 | Kihara et al. | 57/302 |
| 3,895,483 | 7/1975 | Grau | 57/302 |
| 4,022,011 | 5/1977 | Hirai | 57/263 |
| 4,069,654 | 1/1978 | Roehrich | 57/302 |
| 4,178,749 | 12/1979 | Stahlecker et al. | 57/263 |
| 4,211,063 | 7/1980 | Bock et al. | 57/302 |
| 4,265,083 | 5/1981 | Braun et al. | 57/263 |
| 4,676,059 | 6/1987 | Artzt et al. | 57/263 |

*Primary Examiner*—John Petrakes

*Attorney, Agent, or Firm*—Dority & Manning

[57] ABSTRACT

In an open-end spinning device with a spinning rotor a compressed air conduit is provided for directing an air current upon the inner surface of the spinning rotor. This compressed air conduit is connected through a stop valve to a source of compressed air. The compressed air conduit is provided with a pressure control device which can be pre-set to at least two pressure levels. The pressure control device has parallel conduits of which one conduit is provided with a pressure reduction device for the low pressure.

During the preparation of the piecing operation, compressed air, at high pressure, is fed into the spinning rotor to clean said spinning rotor. Subsequently, but before the start of fiber feeding into the spinning rotor, the compressed air is reduced to a lower pressure value and is finally switched off before the yarn is fed back into the spinning rotor.

The invention includes the process for restarting the open-end spinning device. Both the process and the device may be manually or automatically operated.

30 Claims, 9 Drawing Sheets

$n_R$
$P_R$
$P_{RN}$
$P_{RO}$
$P_{RH}$
$P_L$
$P_{LH}$
$P_{LN}$
$R_R$
$t_{F'}$
$t_F$
$Q_F$
$V_F$
$V_G$
$F_B$
$V_A$
$S_A$
$F_A$
t $n_R$
$P_R$
$P_{RH}$
$P_{RN}$
$P_{RO}$
$P_L$
$P_{LH}$
$P_{LN}$
$Q_F$
$V_F$
$A_H$
$A_S$
$V_G$
$R_R$
$F_R$
$V_A$
$S_A$
$F_A$

OPEN-END SPINNING MACHINE AND PROCESS FOR THE START-UP OF SUCH A DEVICE

BACKGROUND AND SUMMARY OF THE INVENTION

The instant invention relates to an open-end spinning machine with a spinning rotor. It has a compressed air conduit directed upon the inner surface of the spinning rotor for the purpose of cleaning it, with the spinning device being closed. It is connected through a stop valve to a source of compressed air. The invention also includes a process to start up such a device.

The feeding of compressed air to the rotor of an open-end spinning device to clean it of deposits and fibers is known in German patents DE 28 11 960 A1 (now U.S. Pat. No. 4,265,083) and DE 27 35 311 A1 (now U.S. Pat. No. 4,211,063). The impurities and fibers loosened by the stream of compressed air are removed by suction.

In another device shown in German Patent DE 27 25 105 A1 (now U.S. Pat. No. 4,178,749) fiber feeding is resumed and stopped before the actual piecing process, in order to remove fibers unsuitable for said piecing process. In this way a fiber tuft of identical nature in quality and quantity is always produced for piecing. To ensure that these fibers, which are temporarily fed into the rotor, are again removed from said spinning rotor reliably, the pressure is maintained beyond this pre-feeding stage until the beginning of the actual piecing process. This pressure can be of only low value, as the fibers would otherwise be prevented, during pre-feeding, from reaching the spinning rotor. This leads to interference in the piecing process. If the pressure is too low, the desired cleaning effect, necessary in order to loosen the impurities, is not attained.

SUMMARY OF THE INVENTION

It is, therefore, the object of the instant invention to improve the known device and the known process in the sense that thorough cleaning of the spinning rotor with reliable removal of the fibers and impurities in the spinning rotor on the one hand, and, on the other hand, a fiber tuft of constant, equal quality may be obtained.

This object is attained through the invention by means of a pressure control device which can be preset to at least two different pressures, whereby either one or the other pressures can be fed to the stop valve to carry out the piecing process. In this way it is possible to feed a stream of compressed air under high pressure to the spinning rotor following a yarn breakage to loosen the fibers accumulated, in the meantime, in the spinning rotor from the collection groove. They are removed under the action of the suction air stream which produces a negative spinning pressure. At the same time, the fiber ring formed by the fibers is broken up. Depending on the location between collection groove and draw-off rollers, at which the yarn breakage has occurred, a yarn section of greater or lesser length gets into the collection groove at such an occurrence, and must also be removed from the groove.

During the feeding of the compressed air stream at high pressure, the spinning rotor is not stopped but drifts, so that the centrifugal force acting upon material to be removed, decreases gradually in time while the compressed air can, nevertheless, still be fed to each point of the circumference of the collection groove. Once the spinning rotor is cleaned, a fiber tuft of constant quality must be produced for piecing. This is done either by temporary advance feeding for a fixed time interval from the start of fiber feeding required for the spinning process or the advanced start of fiber feeding, whereby the fibers are, at first, prevented from getting into the spinning rotor until they are needed in the spinning rotor for piecing, i.e. for the beginning of the spinning process. During the period lasting until the beginning of fiber feeding into the spinning rotor and after the advance feeding is switched off, or after pre-start of the fiber feeding, no fibers should enter the spinning rotor on the one hand, and on the other hand the fibers which are present in the opening cylinder housing must be prevented from leaving the housing at any other location, e.g. near the feeding device or at a trash collection opening. For this reason, a compressed air stream at low pressure is fed to the spinning rotor during the period following the completion of rotor cleaning. The device according to invention, thus has two functions. First it is used in the cleaning of the spinning rotor. Additionally, it also has the function of improving the piecing process.

The pressure control device can be controlled in different manners in order to bring the compressed air, at the desired pressure and at the desired moment, to the individual spinning station. According to a preferred embodiment, a pressure sensor, which senses the pressure between the pressure control device and the stop valve, is connected to the pressure control device through a time delay device. Such a pressure sensor senses the pressure in the compressed air circuit and reacts to a pressure drop occurring automatically when a stop valve opens and controls the pressure control device via the time delay device.

The pressure control device can be designed in different ways and can, for example, be provided with a pressure reducing valve which is adjustable in two steps. The level of the compressed air pressure can be controlled with great precision by means of a pressure control device with parallel circuits, of which one circuit is provided with a pressure reduction device. This pressure reduction device serves to determine the lower pressure.

To be able to control the pressure control device simply, whatever its special configuration may be, a control device is preferably assigned to the spinning device, or the spinning device can be provided with a control device which is connected to the pressure control device for control purposes. Such a control device could, for instance, be provided separately for each spinning station, or it could be installed on a servicing mechanism which travels to the individual spinning stations and can thus assign a control device to the spinning station concerned.

As a rule, many identical open-end spinning machines are installed next to each other in one machine. In this case, according to the instant invention, the stop valves of this plurality of identical open-end spinning devices are connected, on the inlet side, to the parallel circuits of the pressure control device, the pressure reduction device of which can be installed before the stop valve by means of a switching device. In this way the required pressure can, in each case, be controlled in a simple manner from each open-end spinning device.

In one embodiment of the device according to the instant invention, especially well suited for manually operated open-end spinning devices, the switching devices are made in form of a reversing valve through which the stop valves of the individual open-end spinning devices can be connected selectively to one or the other of two parallel circuits.

In order to obtain as simply as possible an embodiment of the device according to the instant invention with a plurality of identical open-end spinning devices, the preferred method provides for the stop valves to be connected through a common main circuit to the pressure control device. For the selection of the pressure desired in a particular case, a reversing device capable of being triggered by reversing or switch-over devices assigned to, or capable of being assigned to, the individual open-end spinning devices is provided between the parallel circuits of the pressure control device and the main circuit.

Instead of a reversing device, or in addition to it, provision can be made, in further embodiments of the invention, for a stop valve to stop or release the high pressure provided for the circuit which is parallel to the circuit with the pressure reduction device.

It is advantageous to provide a stop valve, or a separate stop valve, between the pressure reduction device and the main circuit to stop or release the low pressure. In this way it becomes possible to switch off the compressed air connection to the main circuit completely, at times, if this is wanted for any reason. In that case, to be able to use a valve of lesser capacity as the stop valve which follows the pressure reduction device, a check valve for the protection of this stop valve is preferably provided between the main circuit and the stop valve which stops or releases the low pressure.

In a preferred embodiment of the invention, the pressure reduction device is connected, for control purposes, to a piecing unit capable of travelling alongside the open-end spinning devices, the piecing unit being equipped with an activating element that can be assigned to the stop valves and/or reversing devices of the individual open-end spinning devices. In this way the pressure can be selected by the piecing unit at whatever level of pressure is needed at the time, while, on the other hand, the compressed air into the spinning rotor can be released or stopped again by the travelling piecing unit at the individual open-end spinning devices at the desired time.

When several travelling piecing units are provided, the case may occur where high pressure is required for the piecing process controlled by one of the piecing units, while the piecing process controlled by another piecing unit may require a lower pressure. Since several pressures or different degrees of pressure cannot be introduced simultaneously into the common main circuit, provision can be made for the piecing units to be coupled through a common control device in such manner that only the activating element of one of the piecing units is able to function at one time. Alternatively, a separate main circuit can also be provided for each travelling piecing unit.

Then, when several main circuits are provided, in order to be able to feed high or low pressure individually into each main circuit, two parallel circuits are provided at the inlet side for each main circuit. In an advantageous embodiment of the invention, one of said parallel lines, up to and including the pressure reduction device, is assigned to all the main circuits jointly, while the other circuit is provided with a separate stop valve for each main circuit.

In a device in which a controllable suction opening controlling the fiber flow is provided in the peripheral wall of the fiber sliver opening cylinder housing after the inlet opening of the fiber feeding channel, a valve is preferably provided in the circuit to produce the negative spinning pressure in the spinning rotor to assist this air stream. This makes it possible to suck away the fibers and trash particles loosened from the inner wall of the rotor for the duration of rotor cleaning during which fiber feeding is switched off. Later, when fiber feeding is resumed but when the fibers should still not enter the rotor, the negative spinning pressure is switched off so that the fibers go into the controllable suction opening thereby passing over the inlet opening of the fiber feeding channel (see German Patent DE 34 41 677 A1 now U.S. Pat. No. 4,676,059).

In principle, such a valve can be controlled in different ways, e.g. through an electric adjusting element. The control of this valve in the circuit for the production of the negative spinning pressure, is preferably coupled to the movement of the pressure roller of the yarn draw-off device, the pressure roller being installed on a pivoted lever which, in turn, functions as an adjusting element for the valve. In this case, the valve is preferably made in form of a tubular membrane valve. A space-saving arrangement is achieved, according to the invention, by providing the tubular membrane valve with a pivoted clamping lever which works with the lever holding the pressure roller.

Piecing can be carried out in different ways by means of the device according to the instant invention. A process, in which the compressed air is guided into the spinning rotor at high pressure during the preparation of piecing in order to clean the spinning rotor, but in which the pressure is lowered to a lower value before the start of fiber feeding into the spinning rotor and is finally switched off before the yarn is fed back into the spinning rotor, is especially advantageous. By this method, intensive cleaning of the spinning rotor is achieved on the one hand, while simple removal of the fibers before the actual piecing process is ensured on the other hand.

In practice, it is desirable to keep the stoppage time of the spinning machine as brief as possible. For this reason the point in time for switching from the high to the low pressure value is not rigidly set but is preferably selected as a function of the drifting attitude of the spinning rotor which is to be stopped. A long drift period must be taken into account with spinning rotors having a great mass, so that the switching from high pressure to low pressure can take place only at a relatively late point in time. A spinning rotor of low mass comes to a stop much earlier, so that a correspondingly earlier switching from high to low pressure makes it possible to gain time.

The pressure level during the drifting phase of the spinning rotor and during the following phase, during which fiber feeding is released, can easily be determined through tests, but it has been shown to be advantageous if the low value of the pressure lies between 10% and 40% of the high value of the pressure.

The cleaning action can be further intensified if the pressure is switched back and forth once, or several times, between high and low during the drift of the spinning rotor.

According to the preferred process, the fibers fed to the open-end spinning machine after the rotor has come to a stop, are fed into the spinning rotor, whereby the fiber feeding into the spinning rotor is interrupted once more at a set time before the piecing operation, whereby the compressed air is kept at a low value during the entire time of fiber feeding into the spinning rotor. The temporary switching on of the fiber feeding makes it possible to determine exactly the time interval between renewed stoppage of fiber feeding and the start of the piecing process, so that the fiber tuft is in a defined state at the moment of piecing. The compressed air introduced into the spinning rotor during fiber feeding is of a relatively low value, and can even reach the zero value in some cases, if the geometry of the spinning rotor and the suction inside the spinning rotor are such as to ensure that the fibers are removed reliably from the spinning rotor during temporary fiber feeding.

The compressed air is maintained preferably at the low value, even after the completion of the temporary fiber feeding into the spinning rotor and until resumed acceleration of the spinning rotor. This ensures that the fibers which have remained in the clothing of the opening cylinder after fiber feeding has been stopped and which, therefore, enter the spinning rotor even after completion of temporary fiber feeding, are removed immediately and reliably from the spinning rotor.

The process according to the invention is, however, not only advantageous in the case in which the fibers are fed temporarily into the spinning rotor before piecing. According to a further, advantageous process, the fibers are removed without previously entering the spinning rotor, by a flow of suction air after fiber feeding into the open-end spinning device is switched on and continued until the piecing begins, and are fed to the spinning rotor during the piecing, through the suppression of the suction air stream, and the simultaneous suppression of the compressed air. The stream of compressed air which is brought into the spinning rotor, before the piecing process, assists the suction air stream which removes the fibers in the sense that the fibers cannot reach the spinning rotor but are removed on their way, before reaching the spinning rotor. Since the fibers are fed to the spinning rotor, only through the suppression of this suction air stream, and the simultaneous suppression of the compressed air feeding into the spinning rotor, the fibers which do not reach the spinning rotor at the beginning of the piecing process are no different from those fibers which are fed to the spinning rotor during the uninterrupted spinning process. This makes it possible to improve the piecing joint considerably.

In order to assist in the removal of the fibers from the spinning device before they get into the spinning rotor, the negative spinning pressure at the spinning rotor is preferably, switched off during the time during which the fibers are removed from the open-end spinning device without getting into the spinning rotor and is switched on again, at the latest, simultaneously with the interruption of the compressed air into the spinning rotor. The release and/or stoppage of the negative spinning pressure can be gradual in this case, and this further influences the stream of fibers.

In order to have the high pressure immediately available during the piecing in such cases as a yarn breakage, for instance, so that the spinning rotor can be stopped without delay, it is advantageous if the high pressure is prepared in advance after interruption of the compressed air into the spinning rotor, during the piecing process, but without letting it enter the spinning rotor. Time, which would otherwise be required to reconstitute the high pressure is thus saved. This is an advantage if the piecing process is monitored and if the preparation for a new piecing process is initiated immediately if it has failed.

On the one hand, the invention makes it possible, by simple means, to clean the spinning rotor effectively, and thus guarantees permanent good yarn quality. On the other hand, the invention prevents fibers from being deposited in the spinning rotor at an undesirable moment, so that the spinning rotor is sure to be free of fibers before the piecing process begins. In this way, the quantity of fibers deposited in the spinning rotor for piecing can be determined precisely so that the desired piecing joints result. The invention, thus, contributes equally to quality improvement of the piecing joint, and to that of the subsequently spun yarn. The device required for this is simple and requires little room. Additionally it is economical because of lower air consumption. Since it must be built in only at the beginning of a main circuit in one advantageous embodiment of the invention, this device can be built into any already existing machine without difficulty and at low cost. The invention is explained in greater detail through several examples of embodiments.

DETAILED DESCRIPTION OF THE DRAWINGS

Figure 3:
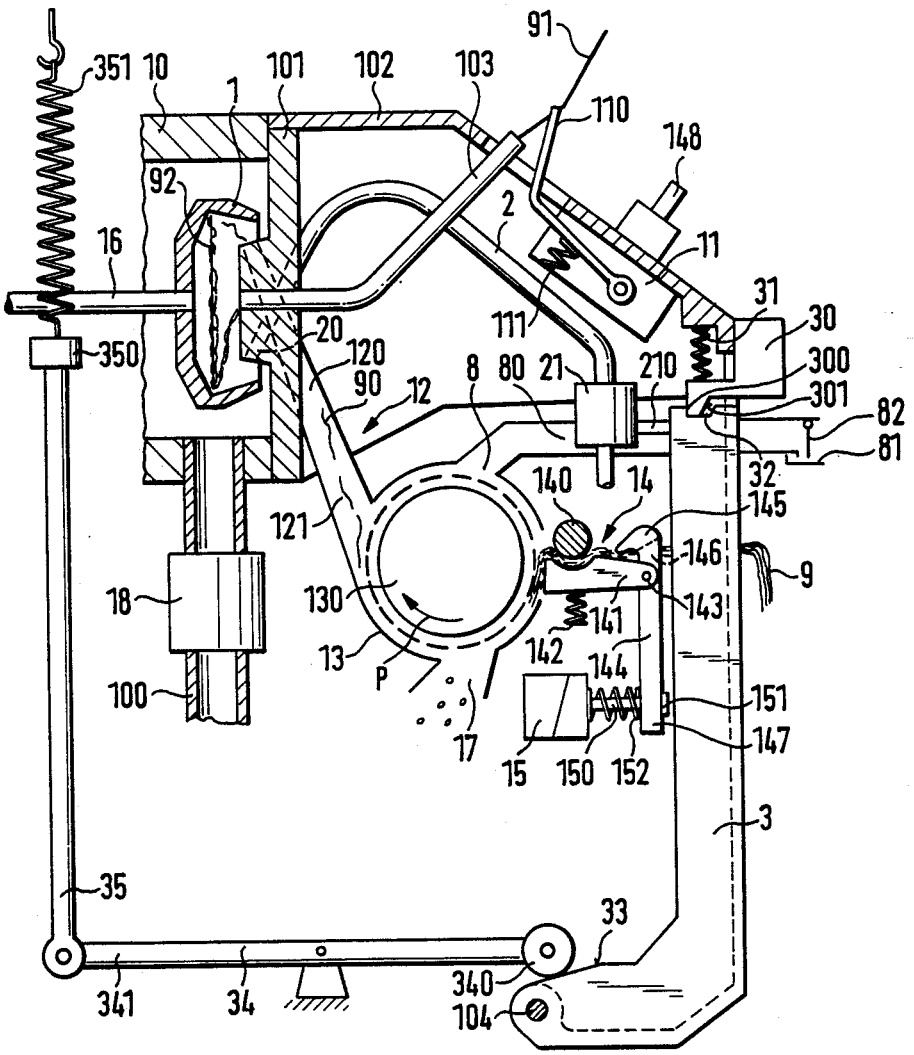
FIG. 3 shows a spinning device suitable to carry out the process according to invention, in cross-section.

The essential components of an open-end spinning device shall first be explained in reference to FIG. 3 which shows, in section, the spinning station of a rotor spinning machine. Each such spinning station is equipped with a spinning rotor 1 to which a fiber sliver 9, opened into fibers 90 is fed and from which the fiber material is drawn off in form of a spun yarn 91.

The spinning rotor 1 is installed in a housing 10, indicated in FIG. 3, and which housing is connected through a suction pipe 100 to a negative-pressure source (not shown) in a known manner. Housing 10 is covered by a cover 101 which is in turn supported by a cover 102 which covers all the elements of the spinning device of a spinning station. Cover 101 contains a yarn draw-off pipe 103 through which yarn 91 is drawn off by means of draw-off rollers (not shown here) and is then fed to a bobbin loading device (also not shown) to be wound up. On its way the yarn 91 passes a yarn monitor 11 with a sensor 110, which, under the pretension of a pressure spring 111, monitors the yarn 91 for the presence or absence of yarn tension.

Cover 101 further contains a component 120 of a fiber feeding channel 12, another component 121 of which is stationary, and which in the shown position of the cover 102, is aligned with component 120 of the fiber feeding channel 12. The fiber feeding channel 12 starts out from an opening cylinder housing 13 which is indicated schematically only and in which a rotating opening cylinder 130 is installed in a known manner.

Upstream of the opening cylinder 130 is a feeding device 14, which, in the design shown, comprises a feeding roll 140 and a feeding plate 141 working together with the former in a resilient manner. The feeding plate 141 is supported pivotably on an axle 143 which also supports, pivotably, a clamping lever 144 which works together with the feeding plate 141. One end of clamping lever 144, fashioned in form of a clamping element 145, can be brought into contact with the feeding plate 141, and the clamping lever can, at the same time, swivel the feeding plate 141 which is subjected to the tension of pressure spring 142 away from feeding roll 140 and, in the process, can clamp the fiber sliver 9 between itself and the feeding plate 141. The clamping lever 144 is equipped with a funnel guide 146 for fiber sliver 9, between its clamping element 145 and swivelling axle 143. On its end 147, away from the clamping element 145, the clamping lever 144 is connected to the anchor 150 of a solenoid 15. Anchor 150 is provided with a catch ring 151 at its end away from the solenoid 15 for catching the clamping lever 144. A compression spring 152 is installed between the solenoid 15 and the clamping lever 144 to urge the clamping lever 144, together with its clamping element 145 against the fiber sliver 9 when the solenoid 15 is de-energized.

Located on cover 102 is a switching knob 148, making it possible to bridge the yarn monitor 11 and to actuate the solenoid 15 independently of the momentary position of the sensor 110 of the yarn monitor 11.

Inside cover 101 is a compressed air current conduit 2, which current is directed through one or more outlets 20 upon the inner surface of the spinning rotor 1. A stop valve 21, which is located in the compressed air conduit 2 and which is supported by the cover 102, can be activated by a control lever 3.

The control lever 3, as well as cover 102, is pivoted on a joint pivoting axle 104 and is put under pressure in the direction out and away from the cover 102 in a manner to be described below in greater detail. In the longitudinal direction of the control lever 3, i.e. in a vertical direction as seen in FIG. 3, a switching knob 30 is shiftably supported on the cover 102, and is subjected to pressure in direction of the control lever 3 by means of a pressure spring 31 which bears against cover 102. On its end on the side of switching knob 30, control lever 3 is provided with a recess 32 into which recess the switching knob 30 can catch by means of a catch projection 300. The catch projection 300 is provided with a leading bevel 301 on its side towards the tending side (the right side in FIG. 3), so that the control lever 3 can be brought into the position shown in FIG. 3 even without controlled lifting of the switching knob 30.

Near its swivelling axle 104, the control lever 3 is equipped with a control cam 33 which works together with a follower 340 located at the end of a two-arm intermediate lever 34. The intermediate lever 34 is connected at end 341 to a drawbar 35 which, on its end away from intermediate lever 34, carries a brake 350 which is held a distance from a shaft 16 which supports the spinning rotor 1 against the pull of a tension spring 351.

Figure 2:
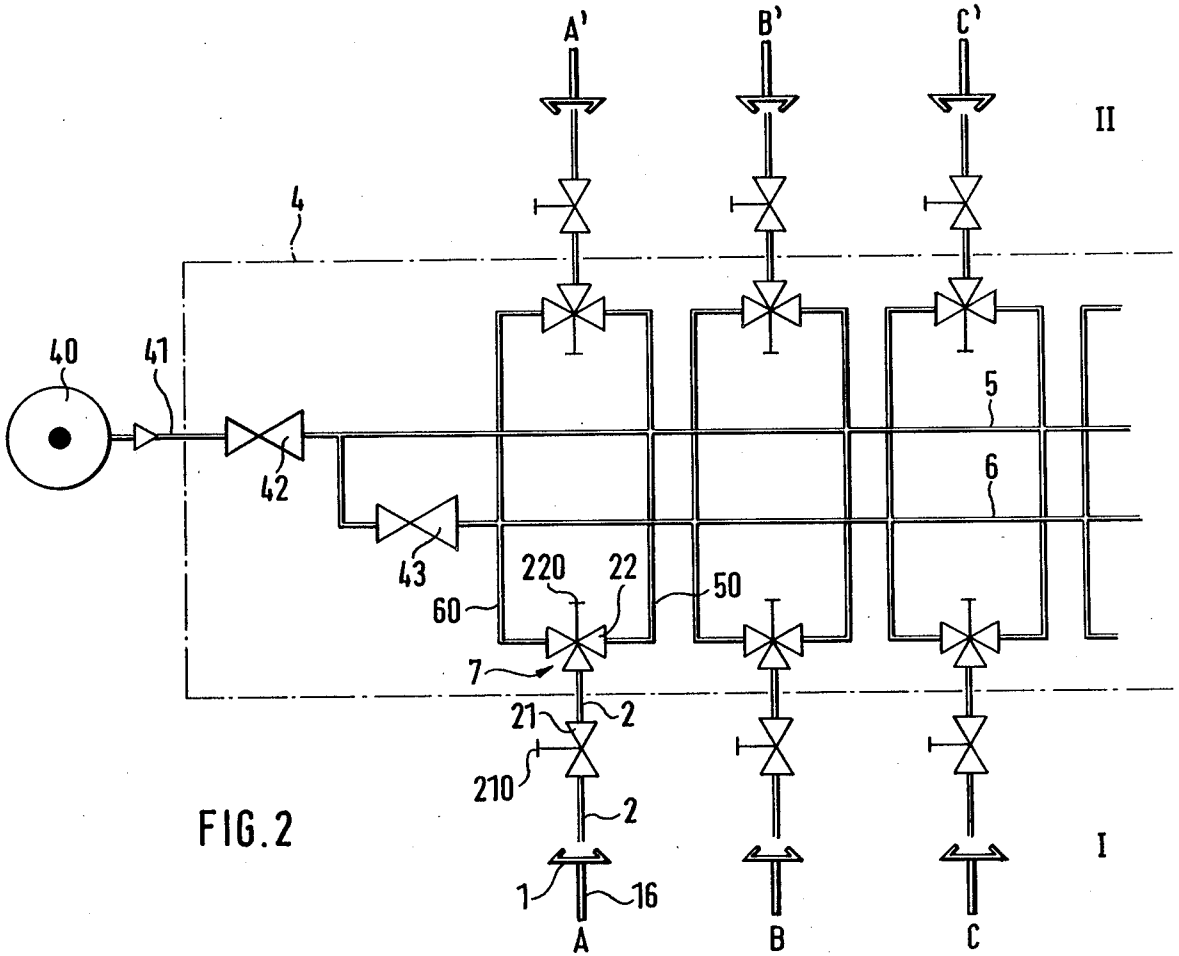
FIG. 2 is a schematic illustration of a first embodiment of the device according to the invention.

FIG. 2 schematically shows a portion of a two-sided open-end spinning machine in which a plurality of identical spinning stations A, B, and C of machine side I and a plurality of identical spinning stations A', B', and C' of machine side II are represented.

As shown, through the example of spinning station A, each compressed air conduit 2 is connected through the stop valve 21 (see FIG. 3) to a pressure control device 4 which is, in turn, connected to a compressed air source 40. The pressure control device 4, installed upstream of the stop valves 21 of the different spinning stations A, B, and C and A', B', and C', contains for each of the spinning stations A, B, and C and A', B', and C' a reversing valve 22 the outlet side of which is connected to the inlet side of a corresponding stop valve 21. Each reversing valve 22 is connected through a connection conduit 50 to a conduit 5 and through a connection conduit 60 to a conduit 6. Conduit 5 is used to feed compressed air under relatively high pressure, while conduit 6 is used to feed compressed air under lesser pressure. The reversing valves 22 of the other spinning stations B and C and A', B', and C' are also connected to the conduits 5 and 6.

The pressure control device 4 is also equipped with a pressure reduction valve 42 in a first conduit segment 41 which is connected to the compressed air source 40, the pressure reduction valve 42 serving to determine the high pressure which takes effect in conduit 5. At the outlet of this pressure reduction valve 42, the conduit segment 41 divides into the two earlier-mentioned parallel conduits 5 and 6, whereby the conduit 6 is provided with a pressure reduction device 43 which, according to FIG. 2, is also in form of a pressure reduction valve. This pressure reduction device 43 determines the lower pressure for conduit 6.

In the open-end spinning machine shown in FIG. 2, each of the stop valves 21 of the different spinning stations A, B, and C and A', B', and C' is connected via a reversing valve 22 on the inlet side with the parallel conduits 5 and 6 of the pressure control device 4. Here, the reversing valves 22 constitute control devices 7, by means of which either conduit 5 or conduit 6 of the pressure control device 4 of each spinning station A, B, and C and A', B', and C' can be selectively connected to conduit 2.

Figure 1:
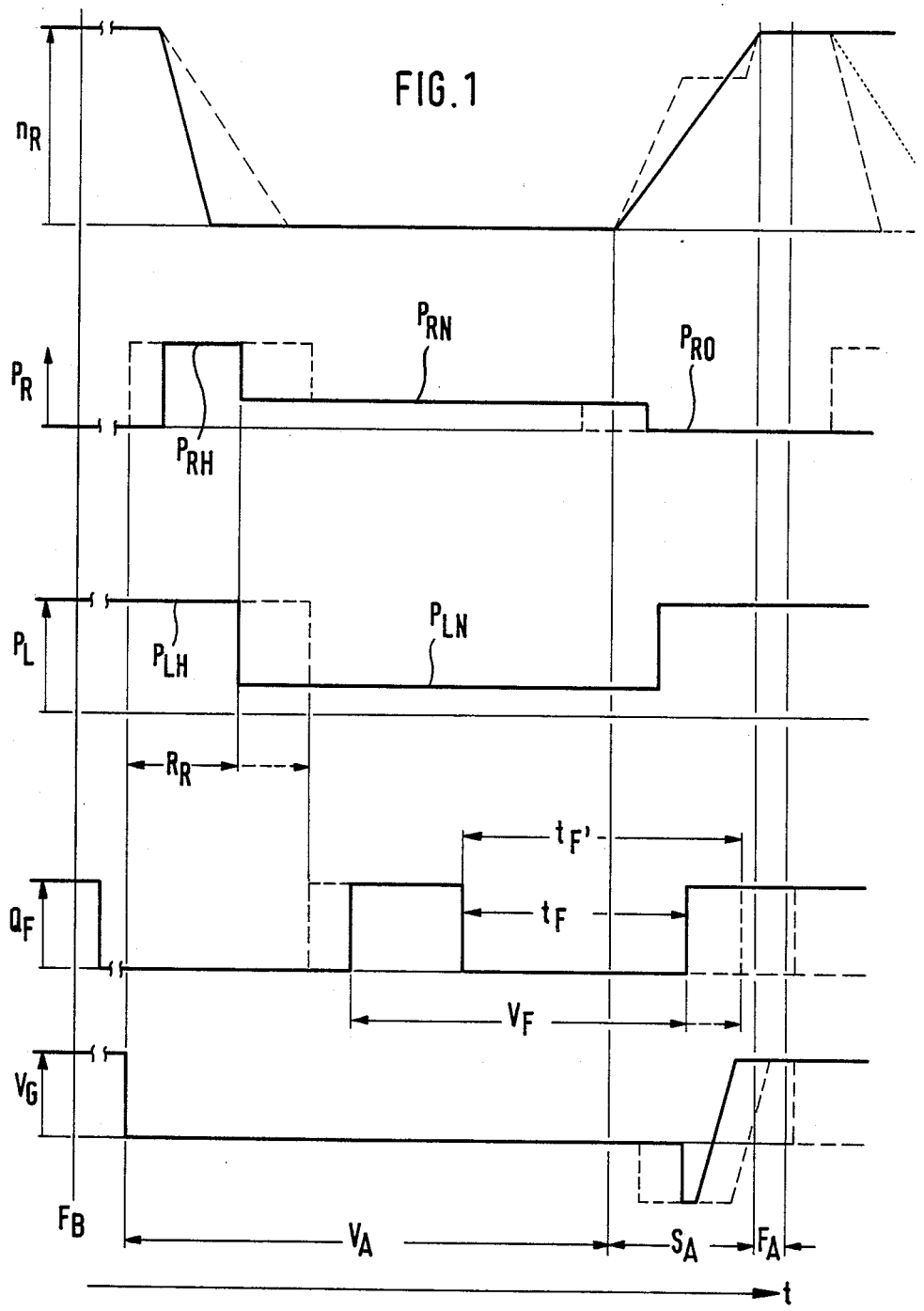
FIG. 1 shows, in a time table, the control and operational steps required for the preparation of a piecing process and for the piecing process itself.

The device having thus been described from the point of view of its structure, the piecing process is to be explained below with reference to FIG. 1. FIG. 1 shows, one above the other in different curves, the rotor speed $n_R$, the compressed air current onset $P_R$ in the spinning rotor 1, the connection of compressed air $P_L$ to the compressed air conduit 2 upstream of stop valve 21, the fiber feeding $Q_F$ as well as the movement $V_G$ of thread in the direction of the return feeding or draw-off. The passage t of time is shown horizontally. $F_B$ designates the occurrence of a yarn breakage. $V_A$ designates the time for the preparation for the piecing process $S_A$, $V_F$ the preparation of a defined fiber tuft. $R_R$ defines rotor cleaning and $F_A$ the period during which detection is possible to determine whether the piecing process was successful or not. Further details shall be explained below in the context of function description.

As shown in FIG. 3, the sensor 110 of the yarn monitor 11 is held, during normal spinning, in its pivoted position by the tension of the yarn in opposition to the effect of pressure spring 111. If a yarn breakage $F_B$ occurs, the yarn 91 releases the sensor 110 which is brought by pressure spring 111 into its end position. The yarn monitor 11 closes a switch and causes immediate cessation of the fiber feeding $Q_F$ through activation of the solenoid 15. The clamping lever 144 is, at the same time, brought in a known manner to bear with its clamping element 145 against fiber sliver 9 and the feeding plate 141 is pivoted away from feeding roll 140.

The yarn monitor 11 also causes take up of yarn 91 to be stopped when the yarn breakage $F_B$ occurs by stopping the bobbin loading device (not shown).

The yarn breakage $F_B$ also causes the yarn monitor 11 to emit a signal which indicates that a piecing operation must be carried out at this particular spinning station, e.g. spinning station A. The indication can be effected by means of a signalling lamp (not shown) of which one is installed for each of the spinning stations A, B, and C or A', B', and C'. The operator now goes to spinning station A and pushes the switching knob 30 against the effect of pressure spring 31 so that the catch projection 300 releases the control lever 3 which is now pivoted out of the cover 102 (i.e. to the right in FIG. 3) under the action of the tension spring 351. At the same time follower 340 runs along the control cam 33 so that the drawbar 35 can now follow the pull exerted by the tension spring 351 and brings brake 350 to bear against shaft 16. As a result, the spinning rotor 1 is braked to a stop (see rotor speed $n_R$ in FIG. 1).

As FIG. 1 shows, compressed air under high pressure was first made available through an appropriate switching position of the reversing valve 22 in the compressed air conduit 2 (upstream of the stop-valve 21). The release of control lever 3 and the pivoting out of the lever from the cover 102 causes control lever 3 to release the switching bolt 210 of the stop valve 21 so that the compressed air, now at high pressure, reaches the interior of the spinning rotor 1 (see compressed air $P_{RH}$ in FIG. 1). This compressed air $P_{RH}$ explodes the fiber ring 92, which is still present in the rotating spinning rotor 1. As the spinning rotor 1 drifts, the centrifugal force finally becomes so weak that the suction air taking effect in suction conduit 100 is able to suck the exploded fiber ring 92 and the fibers 90, which were continued to be fed by the opening cylinder 130 and had been in the clothing, out of the spinning rotor 1 and out of housing 10. As the curve for the rotor speed $n_R$ shows, the spinning rotor 1 requires time periods of varying length before it stops depending on the mass of said spinning rotor 1. The compressed air feeding $P_R$ at high pressure must be correspondingly of varying duration (see $P_{RH}$), and this is why the point in time for the switch-over from high to low pressure must be selected as a function of the drifting properties of the spinning rotor 1, as is shown in FIG. 1, so that no time may be wasted.

When the spinning rotor 1 has been stopped, the compressed air feeding $P_R$ is switched over to a low pressure (see compressed air $P_{RN}$), and this is effected through activation of drive element 220 of reversing valve 22. The compressed air current now reaches the interior of spinning rotor 1 at low pressure through the stop valve 21, which continues to remain open. After the reversal of the reversing valve 22 the solenoid 15 is now actuated by switching knob 148 in such manner that it again pivots the clamping lever 144 together with its clamping element 145 away from the feeding plate 141 and thus releases the fiber sliver 9 once more. The feeding plate 141, which once more approaches the feeding roll 140, causes the fiber sliver 9 to be fed once more to the opening cylinder 130 and to be opened into fibers 90 by the cylinder, said fibers being fed to the interior of the spinning rotor 1. Because of the pressure taking effect in the compressed air conduit 2, the fibers 90 are immediately whipped up and prevented from settling in the spinning rotor 1 which is still stopped. Fibers 90 are immediately sucked out of the spinning rotor 1 by the negative pressure taking effect in the suction conduit 100 and are removed. Feeding of fibers 90 into the spinning rotor 1 causes that portion of fiber sliver 9 which has become unusable, after the yarn breakage $F_B$ has occurred, to be carried off.

After a period of time which is sufficient to remove the unusable portion of fiber sliver 90, the fiber feeding $Q_F$ is once more stopped by releasing the switching knob 148 for the solenoid 15, so that clamping of the fiber sliver 9 and pivoting-away of the feeding plate 141 from the feeding roll 140 causes the delivery of fibers to the opening cylinder 130 to be interrupted again.

After stopping the feeding device 14, but still before the start of the piecing process $S_A$, the compressed air feeding $P_R$ into the spinning rotor 1 is switched off once more (see compressed air $P_{RO}$). For this reason, the control lever 3 is again lifted in the device shown in FIG. 3, and is pressed into the cover 102. At the same time, the control lever 3 activates the switching bolt 210 and, thereby, interrupts air flow into the spinning rotor 1. The control lever 3 runs up, at the same time, with its upper end against the leading bevel 301 of the switching knob 30 and briefly lifts it until the catch projection 300 snaps into the recess 32 of the control lever 3 and immobilizes the latter in the position shown in FIG. 3.

During the return pivoting of the control lever 3 into the shown starting position, brake 350 also releases shaft 16 of the spinning rotor 1 once more, whereby shaft 16 accelerates to its operating speed (see rotor speed $n_R$).

The actual piecing operation is carried out in synchronization with this rotor acceleration. For this purpose, the piecing process is also synchronized with the moment at which the temporary fiber feeding $Q_F$ into the spinning rotor 1 is interrupted, in such manner that a fixed time period $t_F$ passes from the moment of interruption of the temporary fiber feeding $Q_F$ into the spinning rotor 1 to the moment at which the fiber feeding $Q_F$ into the spinning rotor is switched on again. As a result, the fiber sliver is in a predetermined state at the moment of piecing.

Shortly after control lever 3 is returned into the basic position shown in FIG. 3, reversing valve 22 is reversed, according to FIG. 1, so that compressed air at high pressure is again made available in the portion of the compressed air conduit 2 upstream of the stop valve 21.

In synchronization with the renewed release of the fiber feeding $Q_F$, the yarn 91 is fed back into the spinning rotor 1, and is again drawn out of the spinning rotor 1 after a short sojourn period (see yarn movement $V_G$).

Upon completion of the piecing process, a verification is carried out during a time period $F_A$ to ascertain whether piecing has been successful. If this is the case, spinning station A continues to run at production speed. Otherwise, the piecing operation $S_A$ is repeated, as indicated in the individual curves by dotted lines. Since the preceding reversal of the reversing valve 22 made available compressed air at high pressure (see compressed air $P_{LH}$ and see prepared compressed air $P_L$), the preparation phase $V_A$ for the next piecing process can be initiated immediately.

Since the transition from high to low pressure in the spinning rotor 1 (see compressed air $P_{RH}$ and $P_{RN}$) depends solely on the pressure (see $P_{LH}$ and $P_{LN}$) made available, this reversal coincides for the compressed air feeding $P_R$ and the making available of compressed air $P_L$.

FIG. 1 shows that during the entire preparation phase $V_A$ of the piecing process, including the rotor cleaning phase $R_R$, compressed air is directed into the spinning rotor 1. During the rotor cleaning phase $R_R$, and until stoppage of the rotor is achieved, compressed air at high pressure, e.g. 6 bar, is guided into the spinning rotor. As has been described earlier, this causes the fiber ring 92 to explode and to be sucked out of the spinning rotor 1 together with the individual fibers 90. During the subsequent, temporary fiber feeding phase $Q_F$, the compressed air is then lowered to a lower value, e.g. 1 to 2 bar. The pressure is measured so as to ensure a smooth passage of the fibers 90 from the opening cylinder housing 13 into the fiber feeding channel 12, on the other hand to prevent them, on the other hand from settling in the stopped spinning rotor 1. This ensures that no fibers 90 go around the opening cylinder 130 repeatedly and risk to become stuck in the area of the feeding device 14 or elsewhere in the opening cylinder housing 13. This further ensures that these fibers 90 are prevented from getting into the spinning rotor 1, with the fibers 90 newly fed to the opening cylinder 130 upon release of the fiber feeding $Q_F$ during the piecing process $S_A$, and from jeopardizing successful piecing.

If, as shown in FIG. 3, a trash collection opening 17 is provided in the opening cylinder housing 13 between the feeding device 14 and the fiber feeding channel 12, the pressure is calculated so as to have no adverse effect upon the interior of the opening cylinder housing 13, preventing any fibers 90 from leaving the opening cylinder housing 13 through the trash collection opening 17.

It has been shown that the low-value $P_{RN}$ of the pressure of the compressed air stream guided into the spinning rotor 1 need merely to amount to 10% to 40% of the pressure ($P_{RH}$) required for rotor cleaning $R_R$. The level of the low pressure ($P_{RN}$) depends on several factors such as the rotational speed of the opening cylinder 130, the level of the negative pressure in the suction conduit 100, the geometry of housing 10 and the spinning rotor 1, etc.

As shown by the time periods $t_F$ and $t_F$ in FIG. 1, the release of fiber feeding $Q_F$ can occur at different moments in relation to the acceleration of the rotor speed $n_R$, although the time period $t_F$ is a fixed time period. In order to prevent unwanted fibers 90 from settling in the spinning rotor 1 during this fixed time period $t_F$ or $t_F$ extending from the switching off of the intermediate fiber feeding $Q_F$ during the preparation $V_A$ of the piecing process to the renewed switching on of the fiber feeding $Q_F$ during the piecing process $S_A$, the pressure of low value ($P_{RN}$) is maintained at least for the duration of the intermediate fiber feeding $Q_F$. It is advantageous to maintain the compressed air supply at low pressure even after completion of the temporary fiber feeding $Q_F$ until the acceleration of the spinning rotor 1 starts again. Depending on the circumstances, the compressed air supply $P_R$ can also be interrupted as early as before the renewed acceleration of the spinning rotor 1, if, as a function of the prevailing conditions, there is no risk that fibers 90 or an unacceptable amount of fibers 90 continue entering into the spinning rotor 1. It is also possible for the yarn feed-back or for the renewed activation of yarn draw-off (see yarn movement $V_G$) as well as the sojourn period of yarn 91 in the spinning rotor 1 to vary depending upon the material, rotor speed $n_R$, etc.

The process described, ensures uniform fiber conveying from the feeding device 14 into the spinning rotor 1 and controlled initiation of the fiber feeding $Q_F$ for the piecing process $S_A$. Failure of the piecing process can, however, still not be excluded, e.g. because of trash particles getting into the spinning rotor 1 during the piecing process. For this reason the spinning process $S_A$ is monitored. It may be sufficient, for this purpose, to monitor yarn 91 for its presence or absence. But provisions can also be made for the piecing joint in yarn 91 to be checked for its quality and for deviations from the preset desired values. If the piecing operation must be considered as having failed, preparation $V_A$ for another piecing process is immediately initiated, as shown in FIG. 1, through control of the yarn monitor 11 or of another, not shown yarn monitor. To avoid any loss of time, the pressure is switched over immediately upon completion of the compressed air feeding $P_R$ into the spinning rotor 1, i.e. already during the piecing process $S_A$, from its low value $P_{LN}$ to its high value $P_{LH}$, according to the process shown in FIG. 1. Since compressed air feeding $P_R$ into the spinning rotor 1 is already interrupted at that moment through the activation of the stop valve 21, the high pressure is made available in this manner without entering the spinning rotor 1.

Control of the prepared compressed air $P_L$ can be effected in different manners, depending upon the configuration of the reversing valve 22. If the drive element 220 is made in the form of a solenoid, for example, a switching element can be provided on the winding device, by means of which this drive element 220 can be controlled. This is especially advantageous since the bobbin must, in any case, first be lifted and then lowered in manually operated spinning machines.

FIG. 2 shows an element in the form of a pressure reducing valve for the determination of the high and the low pressures ($P_{LH}$, $P_{LN}$) (see pressure reducing valve 42 or pressure reduction device 43). It is, of course, also possible to determine the desired pressure by other means, for example with the help of overflow valves where the desired pressure can then be obtained from the conduit system or from the conduit upstream of this overflow valve.

Figure 4:
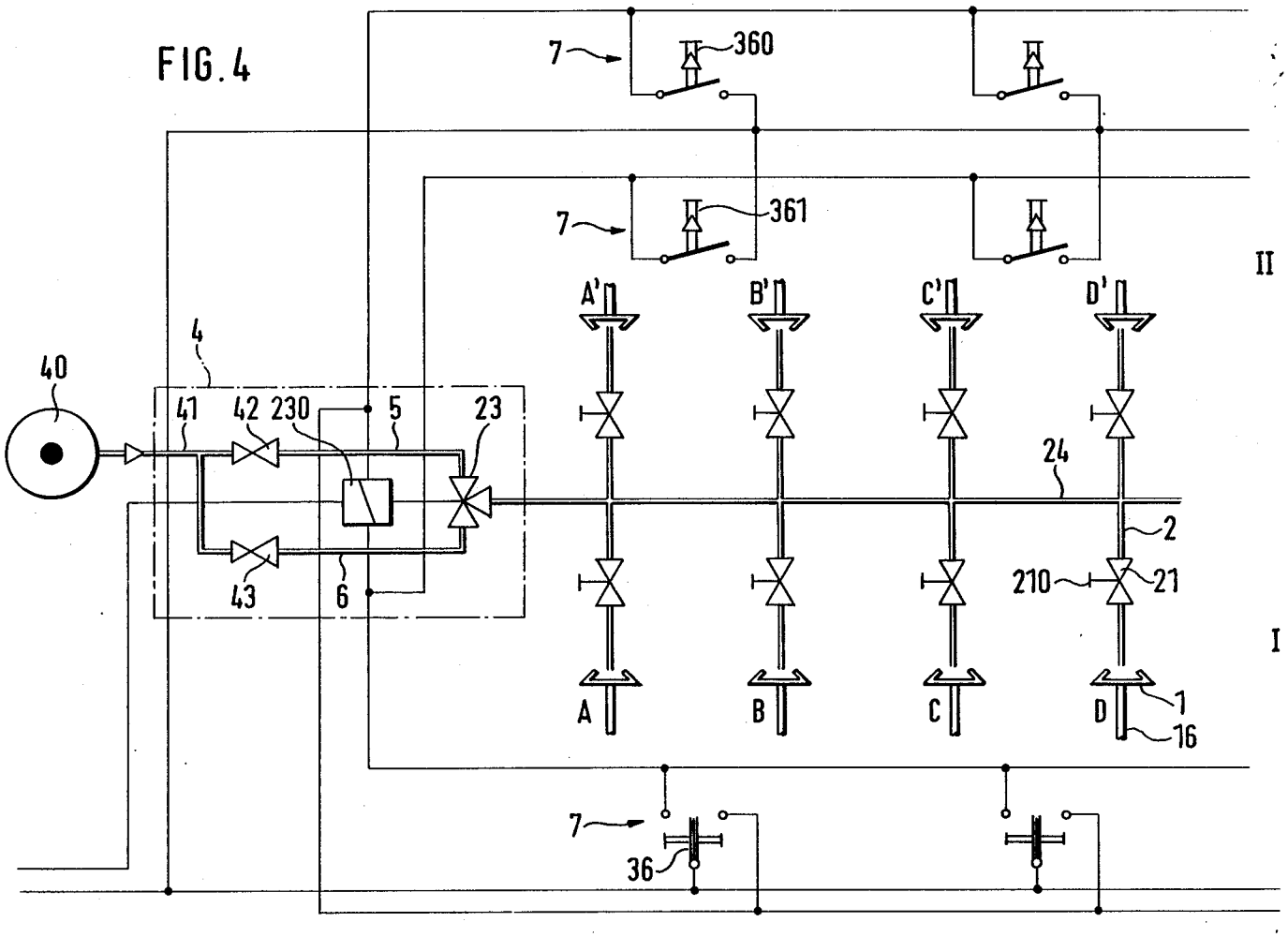
FIG. 4 shows, schematically, an alternate embodiment of the device shown in FIG. 2, in which one main circuit is provided for a plurality of spinning machines.

As a comparison between FIGS. 2 and 4 shows, the element for the determination of the low pressure can be installed in series (as in FIG. 2) with the element determining the high pressure ($P_{LH}$), or else the two elements for the determination of the high and the low pressure (42, 43) can also be installed in parallel to each other (as in FIG. 4).

FIG. 2 shows a device in which a separate reversing valve 22 is provided at each individual spinning station A, B, and C or A', B', and C'. This is of special advantage for test devices with only one or only a few spinning stations. However, it is not necessary to provide such a reversing valve 22 at each spinning station, separately. As FIG. 4 shows, it is sufficient if a single reversing valve 23 is provided for the entire machine. This reversing valve 23 is equipped with a solenoid drive 230 which can be triggered from each spinning station A, B, C, and D or A', B', C', and D'.

A main conduit 24, from which the compressed air conduits 2 with the stop valves 21 of the individual spinning stations A, B, C, and D or A', B', C', and D' branch off, is connected to the outlet side of the reversing valve 23. The stop valves 21 are connected to the parallel conduits 5 and 6 of the pressure control device 4 through a common main conduit 24 which has its start at the outlet of the reversing valve 23.

The two conduits 5 and 6 for the high and the low pressure are connected to the two inlet sides of the reversing valve 23, whereby conduit 6 contains a pressure reducing device 43 in the previously described manner. In contrast to the embodiment shown in FIG. 2, the pressure reducing valve 42 shown in FIG. 4, or another appropriate device for the determination of the pressure, is installed in conduit 5 and not in a conduit segment 41 installed upstream of both conduits 5 and 6, and serving them jointly.

For the control of the solenoid 230 and, thereby, of the reversing valve 23, each of the spinning stations A, B, C, and D or A', B', C', and D' is equipped with a control device 7, without it being necessary for such a control device 7 to be provided for each of the spinning stations A, B, C, and D or A', B', C', and D'. It is sufficient if such a control device 7 is installed so that the desired pressure can be made available for the appropriate spinning station. For this purpose, such a control device 7 can be installed, either for each one of the spinning stations A, B, C, and D or A', B', C', and D' or for two or more spinning stations, jointly.

FIG. 4 shows different possibilities for the control of the reversing valve 23.

On machine side I, two spinning stations A and B, C and D, in pairs are provided jointly with a control device 7 in the form of a reversing switch 36 which, in one of its end positions, affects the solenoid 230 in such a manner that the reversing valve 23 supplies the main conduit 24 with high-pressure compressed air ($P_{LH}$), and the reversing switch 36 in its other end position affects solenoid 230 so as to cause reversing valve 23 to supply the main conduit 24 with low-pressure compressed air ($P_{LN}$).

For each of the spinning stations A', B', C', and D' of machine side II, a separate switch 360 or 361 is provided to supply the main conduit 24 with high or low pressure.

The above description shows that the process as well as the device, can be varied in many different ways, especially by replacing certain characteristics by equivalents or by other combinations. Although the device has been described through the example of one embodiment, (FIG. 3), other devices can also be used for the control of the compressed air stream as well as for controlling the speed of the spinning rotor 1. In particular, no control lever 3 movable in relation to the cover 102 is required for this. If desired, the stop valve 21 can also be activated directly. Similarly, an electrically controlled brake can be used for the spinning rotor 1 instead of mechanical controls of brake 230.

Figure 5:
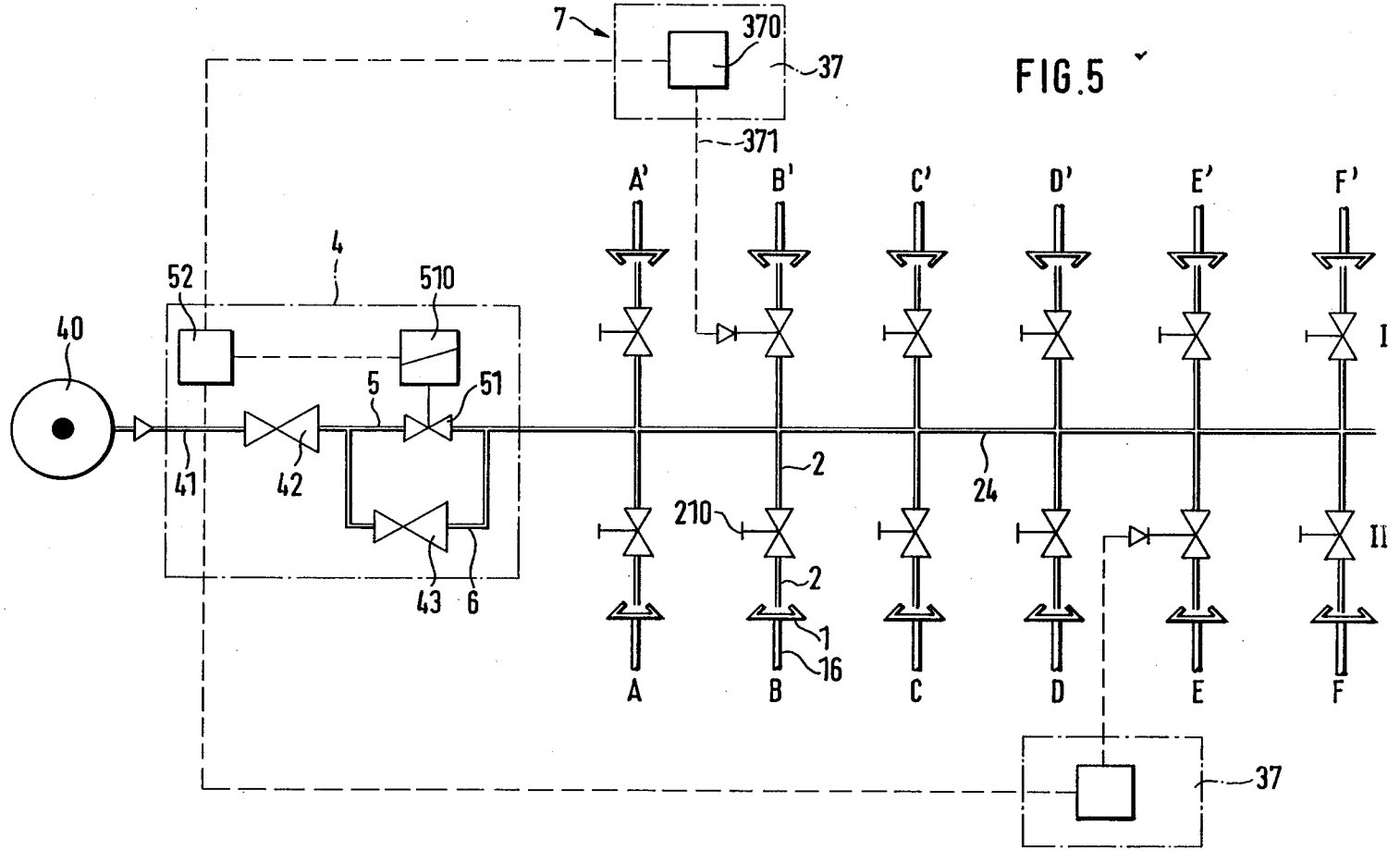
FIG. 5 shows schematically an alternate embodiment of the device shown in FIG. 4, in which the level of the applicable pressure is selected with the assistance of the piecing units travelling alongside the spinning machines.

A further embodiment is illustrated in FIG. 5. While the devices shown in FIGS. 2 and 4 are intended for manual control of the piecing process, FIG. 5 shows that the invention can be used equally well for automatic control. For each machine side I and II, a piecing unit 37, capable of travelling alongside a machine side I or II, is equipped with a piecing control device 370 for the control of the piecing process. This piecing control device 370 is suitably connected through an activating element, e.g. through a control bolt or similar device (see effective connection 371), to the control bolt 210 when the piecing unit 37 has come to a stop at one of the spinning stations spinning stations A, B, C, D, E, or F Or A', B', C', D', E', or F' to carry out the piecing process. Upon completion of the piecing process this effective connection 371 is disconnected.

The effective connection 371 is provided with an activating component such as a lever, for example, which lifts control knob 30 to release the control lever 3, as well as with a bolt to return the control lever 3, later, into its basic position. At the same time the stop valve 21 is also activated in the manner described earlier. However, it is also possible to provide an activating element in form of a device which triggers the stop valve 21 mechanically, electrically or in some other way, without touching it, possibly through an interposed computer provided at one machine end.

For the making available compressed air $P_L$ in the main conduit 24, the compression control device 4 (shown in FIG. 4) can be used, whereby solenoid 230 can be controlled by the travelling piecing unit 37. In that case, the piecing unit 37 replaces the reversing switch 36 or switches 360 and 361 of FIG. 4, and constitutes, by itself, the control device 7, where it is assigned to a specific spinning station A, B, C, D, E, or F or A', B', C', D', E', or F', in that it carries out the servicing operation at this spinning station and works together with it, mechanically and/or electrically.

FIG. 5 shows a modified pressure control device 4, in which a stop valve 51, to stop or release the high pressure ($P_{LH}$), is provided in conduit 5 while a pressure reduction device 43 is again provided in the parallel conduit 6. In the embodiment shown in FIG. 5, pressure reduction device 43 remains constantly connected to main conduit 24 while the stop valve 51 in conduit 5 controls the connection between the main conduit 24 and the conduit segment 41. The stop valve 51 is controlled by means of a solenoid 510 which is, in turn, connected to the piecing units 37 of the two machine sides I and II. To prevent the piecing unit 37 from transmitting conflicting control commands to the solenoid 510, a control device 52, which couples the two piecing units 37 in their function to each other, is inserted between the piecing units 37, on the one hand, and the solenoid 510, on the other hand. Control device 52 synchronizes the two piecing units 37 so that the activating element of only one of the two piecing units 37 can take effect at one time and so that piecing units 37 carry out their work processes staggered in time for the desired compressed air $P_R$ is fed in a time-staggered manner to the spinning rotors 1 to be serviced in synchronization with the piecing process.

Stop valve 51 releases the high pressure $P_{LH}$ at the desired moment, whereby the continually released lower pressure $P_{LN}$ cannot take effect from conduit 6 to the main conduit 24. If on the other hand, the stop valve 51 is switched off, then only the low pressure $P_{LN}$ which prevails in conduit 6 takes effect.

Figure 6:
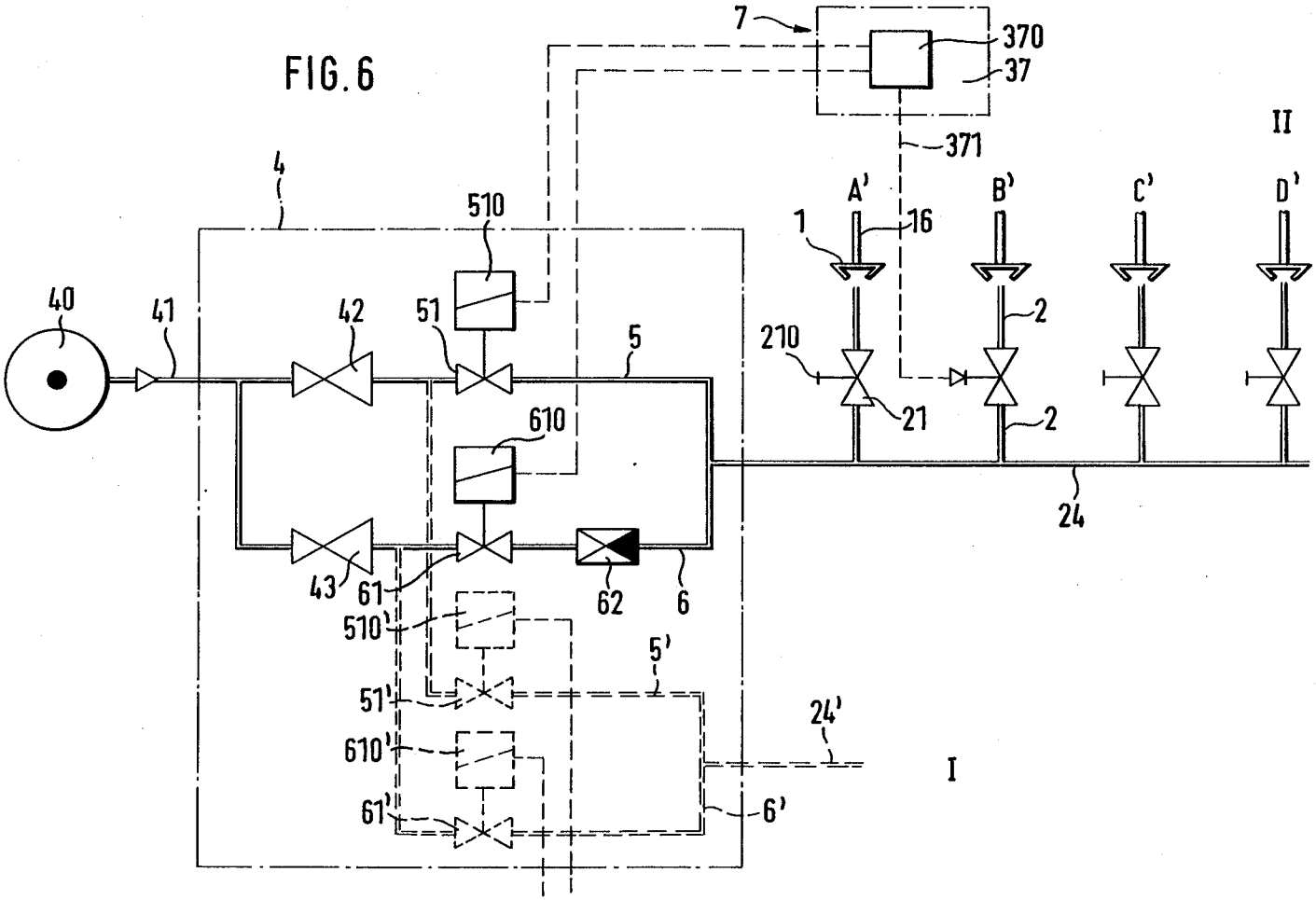
FIG. 6 shows, schematically, another embodiment of the object of the invention, in which control is exercised by a travelling piecing unit.

FIG. 6 shows another variation of the control of the pressure of the spinning rotor 1 during the preparation $V_A$ of the piecing process $S_A$ and during the piecing process $S_A$, itself. The pressure control device 4, in turn, has two conduits 5 and 6, with a pressure reduction valve 42 or some other pressure reduction device followed by a stop valve 51 being installed in conduit 5. The stop valve 51 is, in turn, controlled by the control of the piecing unit 37.

A pressure reduction device 43 which, for example, could also be made in form of a pressure reduction valve, is followed by a stop valve 61 and a check valve 62 installed in conduit 6. The stop valve 61 is under the control of a solenoid 610 which is also connected to the piecing unit 37. Solenoids 510 and 610 are coupled through the piecing control device 370 of the piecing unit 37 so that the stop valve 51 for the high pressure, or the stop valve 61 for the low pressure, alternately enable the compressed air to flow through. The check valve 62 located between the main conduit 24 and the stop valve 61 protects valve 61, but is not necessary. However, it offers the advantage that stop valve 61 can be made in a smaller size because the high pressure $P_{LH}$ in the main conduit 24 is uncoupled by the check valve 62 from the stop valve 61.

When more than one travelling piecing unit 37 is provided for the two machine sides, serving machine side I as well as machine side II, instead of a separate spinning machine 37 being provided for each machine side I and II, a control device 52 must be provided as shown in FIG. 5 in order to ensure reliable and trouble-free control of the pressure $P_L$ in the main conduit 24 which is, in that case, assigned to both machine sides I and II again.

FIG. 6 shows another embodiment of the control of the pressure when separate piecing units 37 are provided for the two machine sides I and II. In order to be able to serve the two sides independently of each other, each piecing unit 37 has its own main conduit 24 or 24' in this embodiment. For this purpose, as shown in FIG. 6, a pressure conduit 5' branches off from conduit 5 between the pressure reduction valve 42 and the stop valve 51 and a conduit 6' branches off from conduit 6 between the pressure reduction device 43 and the stop valve 61. Conduits 5 and 6 both open into the main conduit 24 which is assigned only to machine side II while conduits 5' and 6' open into the main conduit 24' which is provided for machine side I. Conduit 5' contains a stop valve 51' which is controlled by a solenoid 510' while conduit 6' contains a stop valve 61' which is controlled by a solenoid 610'. Solenoids 510' and 610' are connected to a piecing control device 370 of a piecing unit 37 which is provided for machine side I. Due to this configuration of the pressure control device 4, it is possible to control the main conduits 24 and 24' of the two machine sides I and II independently of the piecing units 37 which are separately assigned to a machine side I or II, so that a synchronization of the operation of these two piecing units 37 is not required. Each main conduit 24 or 24' is equipped with two parallel conduits 5 and 6 or 5' and 6', of which one conduit 5, 5' is provided with its own stop valve 51, 51' for each main conduit 24, 24'. The other conduit 6, up to and including the pressure reducing device 43, is assigned to all main conduits 24, 24' jointly. If desired, a separate stop valve 61, 61' can be provided for each conduit 6, 6', i.e. between pressure reducing device 43 and main conduit 24, 24' after their separation. This stop valve 61, 61' serves to stop or release the low pressure.

It is also possible to switch off the prepared compressed air PL completely by means of the stop valves 51 and 61, or 51' and 61' in certain cases, if this should become necessary for any reason.

Similarly, as FIG. 6 shows for the two machine sides I and II, groups of spinning stations which are grouped in a different manner can also be controlled separately by a piecing unit 37, with an individual main conduit 24, 24' with corresponding stop valves 51, 51', and possibly 61, 61' with their solenoids 510, 510' or 610, 610', being assigned to each piecing unit 37 and to each group of spinning stations A', B', C', or D', assigned to piecing unit 37.

Figure 8:
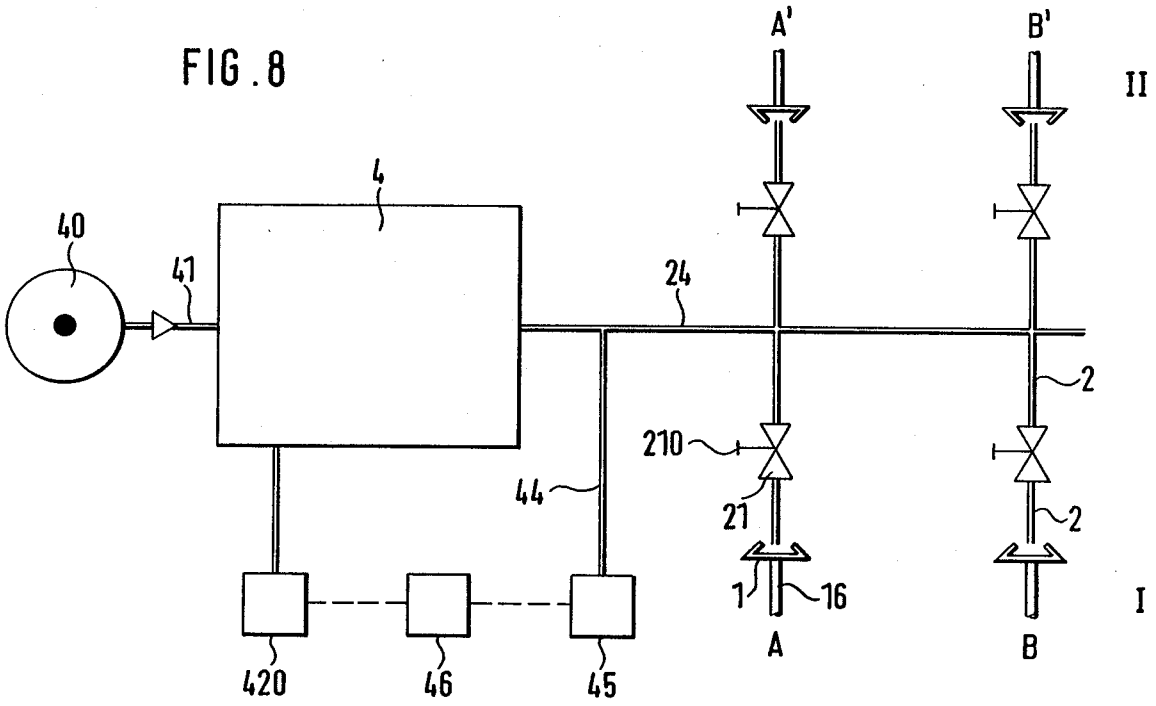
FIG. 8 shows, schematically, yet another embodiment of the device according to invention, in which the control of the pressure control device is exercised as a function of a pressure drop in the compressed air circuit.

A further possibility for the control of the negative pressure is shown in FIG. 8. According to FIG. 8, a common main conduit 24 is provided for the stop valves of one or two rows of spinning stations A, B, or A', B' (machine sides I and II). A pressure sensor 45 is connected to this main conduit 24 through a conduit 44 and is connected for control purposes to a time delay device 46. The time delay device 46 is, in turn, connected to drive 420 of the pressure control device 4 for control purposes.

The pressure control device 4 can be made in different ways, e.g. in the manner shown in FIGS. 2 or 4 to 6. Alternatively, provision can also be made for the pressure control device to assume different control positions and to put the desired pressure at disposal.

If the stop valve 21 is opened at a spinning station A, B or A', B' in order to feed compressed air $P_R$ to the spinning rotor, this results in a pressure drop in the main conduit 24. This pressure drop is detected by the pressure sensor 45 connected to the main conduit 24 and said pressure sensor 45 transmits, in turn, a control impulse to the time delay device 46. The time delay device 46 transmits a control impulse to drive 420 of the pressure control device 4 so that the latter enables the feeding of high-pressure compressed air $P_{LH}$ to the spinning rotor 1. After a predetermined period of time, the time delay device 46 causes the pressure control device 4 to lower the pressure to a lower value $P_{LN}$. The stop valve 21 is then closed in connection with the piecing operation, as was described earlier. The pressure control device 4 then releases the high-pressure compressed air $P_{LH}$ into the main conduit 24 (also under the control of the time delay device 46), so that high pressure can once more build up in the main conduit 24 as a result of the closed stop valves 21. Once this is done, the pressure control device 4 shuts off compressed air $P_R$ into the main conduit 24. If the stop valve 21 is then opened at any one of the spinning stations A, B or A', B' at any subsequent moment in time, high spinning pressure is immediately available.

As mentioned above, high-pressure compressed air ($P_{RH}$) is brought into the spinning rotor 1 while spinning rotor 1 drifts. In the last-described process the pressure, at first, drops off after opening of a stop valve 21, before it climbs again after release by the pressure control device 4. This causes two pressure shocks to be produced against the inner surface of the spinning rotor and these assist in loosening adhering fibers 90 and impurities and also facilitate a breaking up of fiber ring 92. If desired, this effect can be intensified if the pressure is purposefully switched back and forth several times between low and high pressure.

Also in the case of the last-described embodiment the pressure control device 4 is made so that at least two different pressures, $P_{LH}$, $P_{LN}$ can be pre-set and so that one or the other pressure can be fed to the stop valve 21, depending on the execution of the piecing process.

Before the modified process (according to FIG. 7) is described below, reference is made again to FIG. 3, which ⊗ shows an auxiliary suction opening 8 in the direction of fiber feeding (arrow P) in the peripheral wall of the opening cylinder housing 13 surrounding the opening cylinder. This auxiliary suction opening 8 is connected to a suction conduit 80, the end of which away from the auxiliary opening 8 is made in form of a connection piece 81. A piecing unit 37 (see FIGS. 5 and 6) with a suction conduit (not shown) can be connected to this connection piece 81. The connection piece 81 receives a clack valve 82 which normally assumes its closed position under the influence of the negative pressure prevailing in the opening cylinder housing 13. If, however, the piecing unit 37 with a suction conduit (not shown) is connected to the connection piece 81 and if the suction conduit 80 is put under negative pressure by the piecing unit 37, the clack valve 82 opens so that the negative pressure also takes effect in the auxiliary opening 8.

⊗ downstream of inlet portion of fiber feeding channel 12,

A modified piecing unit, by means of which fibers 90 can also be fed to the spinning rotor 1 in a defined manner for piecing, can be used in the described device.

In case of yarn breakage $F_B$, first the fiber feeding $Q_F$ is stopped, according to this process, while yarn 91 is simultaneously brought to a standstill by stopping the winding mechanism (see yarn movement $V_G$). During the breaking of the spinning rotor 1 (see rotor speed $n_R$) compressed air at increased pressure (compressed air $P_{RH}$) is fed into the spinning rotor in order to explode the fiber ring 92, so that the latter may be taken out of housing 10 by the suction air flow prevailing in suction conduit 100. Upon completion of rotor cleaning $R_R$, the pressure is lowered to a lower value (compressed air $P_{RN}$). Following this, a negative pressure $A_H$ is produced at the auxiliary suction opening 8 by application of negative pressure to the suction conduit 80. Shortly thereafter, fiber feeding $Q_F$ is switched on once more. Because of the pressure (compressed air $P_{RN}$) fed to the spinning rotor 1, even though it is low, and because of the negative pressure $A_H$ to which the auxiliary suction opening 8 is subjected, the fibers 90 fed by the feeding device 14 to the opening cylinder 130 are prevented from entering fiber channel 12 and thus spinning rotor 1. Rather, they are removed by the air stream going around together with opening cylinder 130 passing above the input opening of the fiber feeding channel 12 towards the auxiliary suction opening 8 and reach the piecing unit 37 through the suction conduit 80.

In synchronization with piecing process $S_A$, i.e. simultaneously with the acceleration of the spinning rotor 1 (see rotor speed $n_R$) and the back-feeding of the yarn 91 and the resumption of yarn draw-off (see yarn movement $V_G$), the flow conditions in the opening cylinder housing 13 are changed so that the fibers 90 enter the spinning rotor 1 once more. This change in flow conditions results from the fact that the negative pressure $A_H$ is switched off in the piecing unit 37 so that auxiliary suction opening 8 is no longer subjected to negative pressure. Simultaneously with this interruption of the of the negative pressure in the suction conduit 80, the arrival of compressed air $P_R$ in the spinning rotor 1 is also interrupted (see compressed air $P_{RO}$), so that the normal negative pressure for spinning, produced through suction conduit 100 in housing 10, again prevails in spinning rotor 1. The fibers 90 arrive in the spinning rotor 1 because of the suppression of the suction air stream, at first produced by the piecing unit 37, and because of the simultaneous interruption of the air arrival $P_R$ in the spinning rotor 1. Since fiber feeding $Q_F$ resumes before piecing of the yarn 91 begins, all the fibers which may have been unusable before the piecing process have been removed so that only perfect fibers 90 are fed into the spinning rotor for the piecing operation $S_A$.

Figure 7:
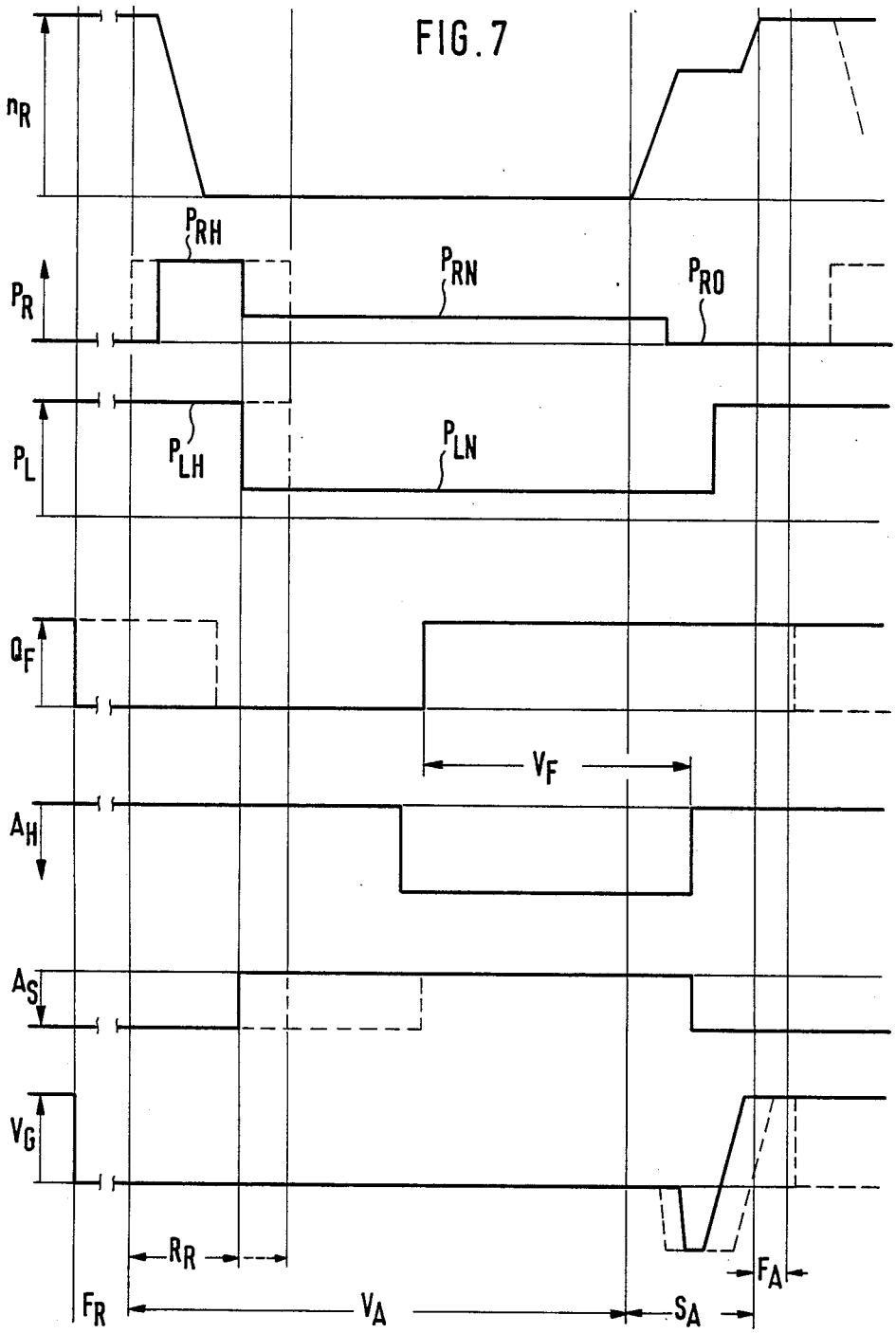
FIG. 7 is a time table for an alternate embodiment of the process shown in FIG. 1.

As a comparison between FIG. 7 and FIG. 1 shows, there are two ways of accelerating the spinning rotor 1 to production speed, either in one step or in two steps. The piecing process can also be carried out in different ways with respect to the sequence of the different operational steps, and with respect to the acceleration of the different aggregates carrying out the piecing operation, whereby the fibers 90 are always at disposal in defined quantities in all instances during the piecing operation $S_A$.

In a piecing process such as illustrated in FIG. 7, it suffices, in general, to control the fiber stream either by means of appropriate control of the negative pressure $A_H$ in the suction conduit 80 and of the pressure $P_R$ in the compressed air conduit 2. However, to make it possible to use less negative pressure $A_H$ for the suction conduit 80, it is advantageous if the negative spinning pressure $A_S$, normally prevailing in housing 10, is switched off for the period during which the fibers 98 should not enter the spinning rotor 1 while feeding device 14 is switched on. For this reason, a valve 18 by means of which the negative spinning pressure $A_S$ produced in the housing 10 can be switched on or off, as desired is installed according to FIG. 3 in suction conduit 100. If an automatic piecing unit is provided, the control of valve 18 is exercised from piecing unit 37. Otherwise, it can be activated or triggered directly or by means of a solenoid (not shown).

Figure 9:
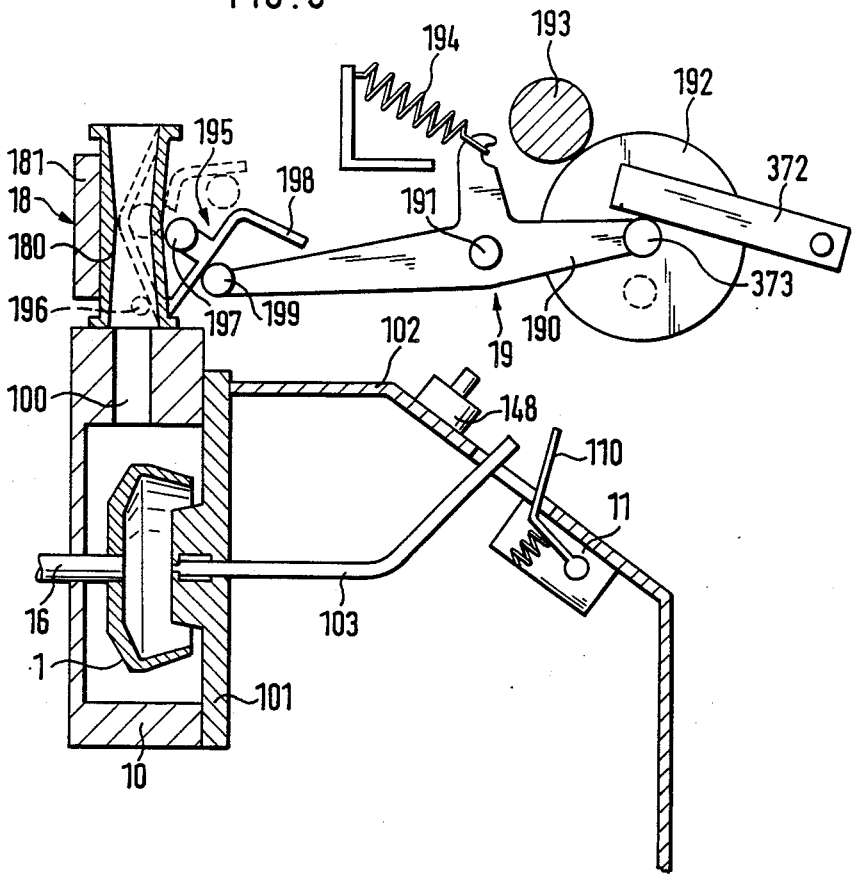
FIG. 9 shows, in schematic cross-section, an open-end spinning device, in which the negative pressure for the spinning device can be controlled at a control device.

According to FIG. 9, which shows an especially advantageous embodiment of the invention, the valve 18 is equipped with an adjusting element 19 which can be activated or triggered manually or by piecing unit 37 (see activating element 372). A pivoted lever 190, pivotably supported on an axis 191, serves as the adjusting element 19. The end away from valve 18 is provided with a drive pin 373 and with a roller 192, which works together with a driven roll 193 and which constitutes a yarn draw-off roller pair, incorporating roll 193, by means of which a yarn 91 can be drawn off from the spinning device. The pivoted lever 190 is put under tension by a tension spring 194 in such manner that the roller 192, constituting the pressure roller of the pair of yarn draw-off rolls, is normally held in contact against roll 193.

The end 199 of the pivoted lever 190 which is near the valve 18 serves as an adjusting element for valve 18. The setting element can act, either directly or indirectly, upon valve 18 for this purpose.

In the embodiment shown in FIG. 9, valve 18 is made in form of a tubular membrane valve. This tubular membrane valve is provided with a pivoted clamping lever 195. This clamping lever 195 is supported on an axle 196 in such manner that it can be pivoted transversely to the valve 18 in form of a tubular membrane valve and can, at the same time, press the tubular membrane 180 against one wall 181 of valve 18 by means of a clamping end 197. The pivoted lever 195 is also provided with drive end 198 which is located so that it can be pressed against the tubular membrane 180 by pivoting pivoted lever 190 while the clamping end 197 releases the tubular membrane when the clamping lever 195 is also released by the pivoted lever 190.

The process, as carried out by the device shown in FIG. 9, is explained below with reference to FIG. 7. As can be seen in FIG. 9, the process can also be carried out manually; since, at present, open-end spinning machines are, as a rule, equipped with automatic piecing units 37, the process shall be described below in connection with such an automatic piecing unit 37:

When a yarn breakage $F_B$ occurs, fiber feeding $Q_F$ is stopped by the yarn monitor 11, as has already been described earlier, and the yarn movement $V_G$ is also stopped by stopping the bobbin winding device (not shown). When the piecing unit 37 has reached the spinning station to carry out the piecing process, the spinning rotor 1 is braked to a stop and the switching knob 148 is activated, in synchronization therewith, by the piecing unit 37 so that it opens the stop valve 21. This causes compressed air to be fed to spinning rotor 1 through compressed air conduit 2. Preceding this, a higher pressure $P_{RH}$ had been prepared in compressed air conduit 2 in the manner already described earlier, so that the spinning rotor can now be effectively cleaned. This ensures, at the same time, that the fiber ring 92 is torn up and enters the suction conduit 100, together with other impurities, through the open edge of spinning rotor 1. At the earliest at the moment at which the pressure of the compressed air flow $P_R$ is reduced (see transition from $P_{RH}$ to $P_{RN}$), but, at the latest, at the moment when the fiber feeding $Q_F$ is released, the negative spinning pressure $A_S$ is switched off. To accomplish this, the activating element 372 of piecing unit 37 is pressed from above against the drive pin 373 and lifts roller 192 away from the driven roll 193 of the pair of draw-off rolls. At the same time, the pivoted lever 190 is pivoted around its axis 191 and presses clamping lever 195 through drive end 198 against the tubular membrane 180 of valve 18, so that said tubular membrane is pressed against the wall 181 of valve 18 opposite clamping lever 195. The negative spinning pressure $A_S$ is thereby switched off, so that only the compressed air $P_{RN}$, which is fed through compressed air conduit 2 prevails in spinning rotor 1 and in housing 10. By applying negative pressure to the auxiliary suction opening 8, a negative pressure $A_H$ becomes effective in the opening cylinder housing 13. This negative pressure $A_H$, added to the compressed air flow which flows through fiber feeding channel 12 in the opposite direction to the normal fiber feeding direction, causes the fibers 90 to be conveyed passing above the inlet opening of the fiber feeding channel 12 to the auxiliary suction opening 8 and to be sucked into the piecing unit 37. Shortly before the yarn 91 is fed back (see yarn movement $V_G$) the activating element 372 releases roller 192 of the piecing unit 37 once more so that the pivoted lever 190 also releases the clamping lever 195 which, under pretension of the tubular membrane 180, goes back into its releasing position. The negative spinning pressure $A_S$ thus again prevails in housing 10, so that the normal negative spinning pressure also prevails in spinning rotor 1. This makes it possible for the yarn 91 to be sucked through the yarn draw-off pipe 103 to the collecting groove of the spinning rotor 1 for the purpose of piecing and so that it may settle down therein.

The actual piecing operation is carried out in the conventional manner, with the end of the yarn 91 being laid into the clamping line of the pair of draw-off rolls (roll 193 and roller 192), also in a known manner.

It is not absolutely necessary for valve 18 to assume either its opening or its closing position. For certain fiber materials, intermediate positions can also be of advantage. For this purpose the activating element 372 can be swivelled gradually, and possibly in steps, into one or the other direction so that the pivoted lever 190 can clamp or release the tubular membrane 180 through clamping lever 195 to a greater or lesser degree. The gradual release of the negative spinning pressure $A_S$ makes it possible to divide the fiber stream in the opening cylinder housing 13 into two parts, especially after resumption of fiber feeding $Q_F$, with one partial stream being removed through the auxiliary suction opening 8 while the other partial stream reaching the interior of spinning rotor 1 and constituting a fiber ring 92 therein. This division of the fiber stream makes it possible to control the formation of fiber ring 92 in spinning rotor 1 precisely, so that effective control of the piecing process and, thereby, the good quality of the piecing joint can be attained.

What is claimed is:

1. An open-end spinning machine, having a plurality of open-end spinning devices, each of which has an open-end spinning rotor and means to clean the inner surface of said rotor with a compressed air current when said device stops for piecing a broken end, said cleaning means having a cleaning conduit for directing said current of compressed air onto the inner surface of said rotor, said conduit being connected to a pressurized source of air and to pressure control means for alternating the pressure of the air in said cleaning conduit, said pressurized source comprising:

(a) a main conduit connected to each of the cleaning conduits of said open-end spinning devices to convey compressed air from said source to said cleaning conduits; and (b) stop valve means disposed in each of said cleaning conduits for selectively directing a current of said compressed air onto the inner surface of the rotor of selected open-end spinning devices to dislodge fibers from said inner surface and to clean said rotor.

2. An open-end spinning machine as set forth in claim 1, wherein a pressure sensor is provided for sensing the pressure between said main conduit and said stop valve means and which is connected to a pressure control means by a time delay device.

3. An open-end spinning machine as set forth in claim 1, wherein said main conduit comprises pressure control means with parallel conduits, one of which contains a pressure reduction means.

4. An open-end spinning machine as set forth in claim 1, wherein said machine is provided with a control means which is connected to a pressure control means.

5. An open-end spinning machine as set forth in claim 1, wherein a pressure control means is connected to a piecing unit which is disposed to traverse alongside said plurality of open-end spinning devices on said open-end spinning machine, said piecing unit being provided with an activating element which selectively activates the stop valve disposed in the cleaning conduit of such open-end spinning device in front of which the piecing unit is disposed to effect yarn piecing.

6. An open-end spinning machine as set forth in claim 5, wherein said machine comprises a plurality of piecing units which are connected to a common control device in such a manner that the activated element of only one of said piecing units can take effect at one time.

7. An open-end spinning machine as set forth in claim 6, wherein each of said traveling piecing units is equipped with a separate main conduit.

8. An open-end spinning machine as set forth in claim 7, wherein each of said main conduits is provided with two parallel conduits, one of which, up to and including the pressure reduction device, is connected to each of the main conduits while the other of said parallel conduits is provided with a separate stop valve for each main conduit.

9. An open-end spinning machine as set forth in claim 5, wherein said machine further comprises a fiber feeding channel, a fiber opening device disposed within a housing connected to said fiber feeding channel, a controllable suction opening disposed in the peripheral wall of said housing after the inlet opening of said fiber feeding channel into said housing, in the direction of feeding and a negative pressure conduit connected to said spinning rotor with a valve disposed in said suction conduit to produce the negative spinning pressure in said spinning rotor.

10. An open-end spinning machine as set forth in claim 9, wherein said machine is provided with a yarn draw-off device comprising a roller disposed on a pivoted lever for lifting off a feed roller by the piecing unit, said pivoted lever including an adjusting element for the valve means.

11. An open-end spinning machine as set forth in claim 10, wherein said valve means in said suction conduit comprises a tubular membrane.

12. An open-end spinning machine as set forth in claim 11, wherein a pivoted clamping lever is disposed adjacent said tubular membrane cooperating with said pivoted lever to close said tubular membrane.

13. A process for restarting an open-end spinning device having at least one open-end spinning rotor whose yarn end is broken, comprising the following steps:

(a) disconnecting said rotor from its drive;
(b) directing a current of air under high pressure against the inner surface of said rotor, while said rotor continues to rotate after being disconnected from its drive, to loosen fiber remaining therein;
(c) sucking said loosened fiber out of said rotor in preparation for the piecing process;
(d) reducing the pressure of said air current against said inner surface;
(e) feeding a predetermined amount of fibers to said cleaned rotor and then stopping said fiber feeding to said rotor;
(f) stopping said low pressure air current from impacting with said inner surface of said rotor;
(g) restarting and accelerating said rotor up to full speed;
(h) back-feeding the end of said yarn into said rotor for piecing; and
(i) restarting the withdrawal of said yarn out of said rotor to recommence spinning of fibers into yarn.

14. A process as set forth in claim 13, wherein the point for reducing the pressure of said air current is selected as a function of the drift attitude of the spinning rotor.

15. A process as set forth in claim 13, wherein the pressure of said air current is reduced to a value which is between 10% and 40% of said high pressure.

16. A process as set forth in claim 13, wherein the pressure of said air current is switched back and forth several times between high and low pressure during the continued rotation of said rotor after being disconnected from its drive.

17. A process as set forth in claim 13, wherein said predetermined amount of fibers are fed to said rotor and the fiber feeding is stopped at a predetermined time before the piecing operation and the current of air is maintained at a lower value during the entire time of fiber feeding into the spinning rotor for being set up again.

18. A process as set forth in claim 13, wherein the reduced pressure of said air current is maintained until the acceleration of the spinning rotor.

19. A process as set forth in claim 13, wherein the fibers are removed by a stream of suction air after the fiber feeding is switched on and until the piecing process begins without said fibers entering the spinning rotor, and said fibers are fed into said spinning rotor during the piecing process by suppressing the stream of suction air at the same time the feeding of said current of air is stopped.

20. A process as set forth in claim 19, wherein the negative spinning pressure in the spinning rotor is switched off during the time in which the fibers are removed from the open-end spinning device without said fibers entering the spinning rotor, and said negative pressure is switched on again at the same time said pressurized air current is stopped.

21. A process as set forth in claim 20, wherein said negative spinning pressure is switched off and/or on gradually.

22. A process as set forth in claim 13, wherein air under high pressure is prepared within a conduit after stopping the entrance of said current into said rotor during the piecing process.

23. A process as set forth in claim 13, wherein said piecing process is monitored and preparation of a new piecing process is initiated if said piecing process fails to repair said broken end.

24. An open-end spinning machine, having a plurality of open-end spinning devices, each of which devices has an open-end rotor and means for cleaning the inner surface of said rotor when said spinning device stops for piecing a broken end, said cleaning means having a cleaning conduit for directing a current of compressed air onto the inner surface of said rotor, said cleaning conduit being connected to a pressurized air source, and pressure control means between the pressurized air source and said cleaning conduit for alternating the pressure of said compressed air current from low to high pressure, comprising:

(a) a pair of parallel conduits, one of which contains a pressure reduction means, said pair of parallel conduits being connected to a plurality of said cleaning conduits for directing a current of air onto the inner rotor surface, said cleaning conduits being connected to said pressure control means by said pair of parallel conduits;
(b) valve control means for each of said cleaning conduits for selectively connecting one of said pair of parallel conduits with said cleaning conduit; and (c) stop valve means in each of said cleaning conduits for selectively connecting said cleaning conduits to said valve means.

25. An open-end spinning machine as set forth in claim 24, wherein the control device comprises a reversing valve through which the stop valve means of each of the individual open-end spinning devices can be connected selectively to one or the other of the two parallel conduits.

26. An open-end spinning machine as set forth in claim 25, wherein said reversing device is disposed between the parallel conduits of the pressure control device and the main conduit.

27. An open-end spinning machine as set forth in claim 24, wherein the stop valve means are connected through a common main conduit to the pressure control device.

28. An open-end spinning machine as set forth in claim 24, wherein said parallel conduit equipped with said pressure reduction device contains a stop valve to stop the high pressure.

29. An open-end spinning machine as set forth in claim 28, wherein a separate stop valve is provided in the conduit between the pressure reduction device and the main conduit to stop the low pressure.

30. An open-end spinning machine as set forth in claim 29, wherein a check valve is provided between the main conduit and the stop valve which stops the low pressure to protect said stop valve.

* * * * *